United States Patent [19]

Zanon et al.

[11] Patent Number: 5,032,818

[45] Date of Patent: Jul. 16, 1991

[54] ADJUSTABLE ELECTRIC THERMOSTAT WITH TEMPERATURE COMPENSATION

[75] Inventors: Piero Zanon; Luigi Dolza, both of Almese, Italy

[73] Assignee: C.A.E.M. S.r.l., Turin, Italy

[21] Appl. No.: 576,037

[22] Filed: Aug. 31, 1990

[30] Foreign Application Priority Data

Nov. 3, 1989 [EP] European Pat. Off. ..... 89830477

[51] Int. Cl.[5] ..... H01H 37/76; H01H 37/12

[52] U.S. Cl. ..... 337/319; 337/323; 337/327

[58] Field of Search ..... 337/312, 313, 314, 315, 337/317, 318, 319, 323, 327

[56] References Cited

U.S. PATENT DOCUMENTS 4,260,977 4/1981 Kicherer et al. ..... 337/318

4,710,742 12/1987 Cors et al. ..... 337/319

*Primary Examiner*—Harold Broome

*Attorney, Agent, or Firm*—Guido Modiano; Albert Josif

[57] ABSTRACT

An adjustable electric thermostat comprises a main housing in which an adjustment shaft is threadedly engaged so that the shaft end inside the housing is displaced when the shaft is turned, a heat transducer mounted on the shaft end, and a switch comprising a channel-shaped, rigid member having a base portion attached on a wall of the housing and opposite branches having notches to support a snap-action blade so that the temperature transducer abuts transversely against an intermediate point in the blade. According to the invention, the channel-shaped member is made of a bimetal plate having the most expansible metal on the outside, so that the branches of the channel-shaped member bend toward each other when the channel-shaped member is heated.

1 Claim, 1 Drawing Sheet

Fig. 1
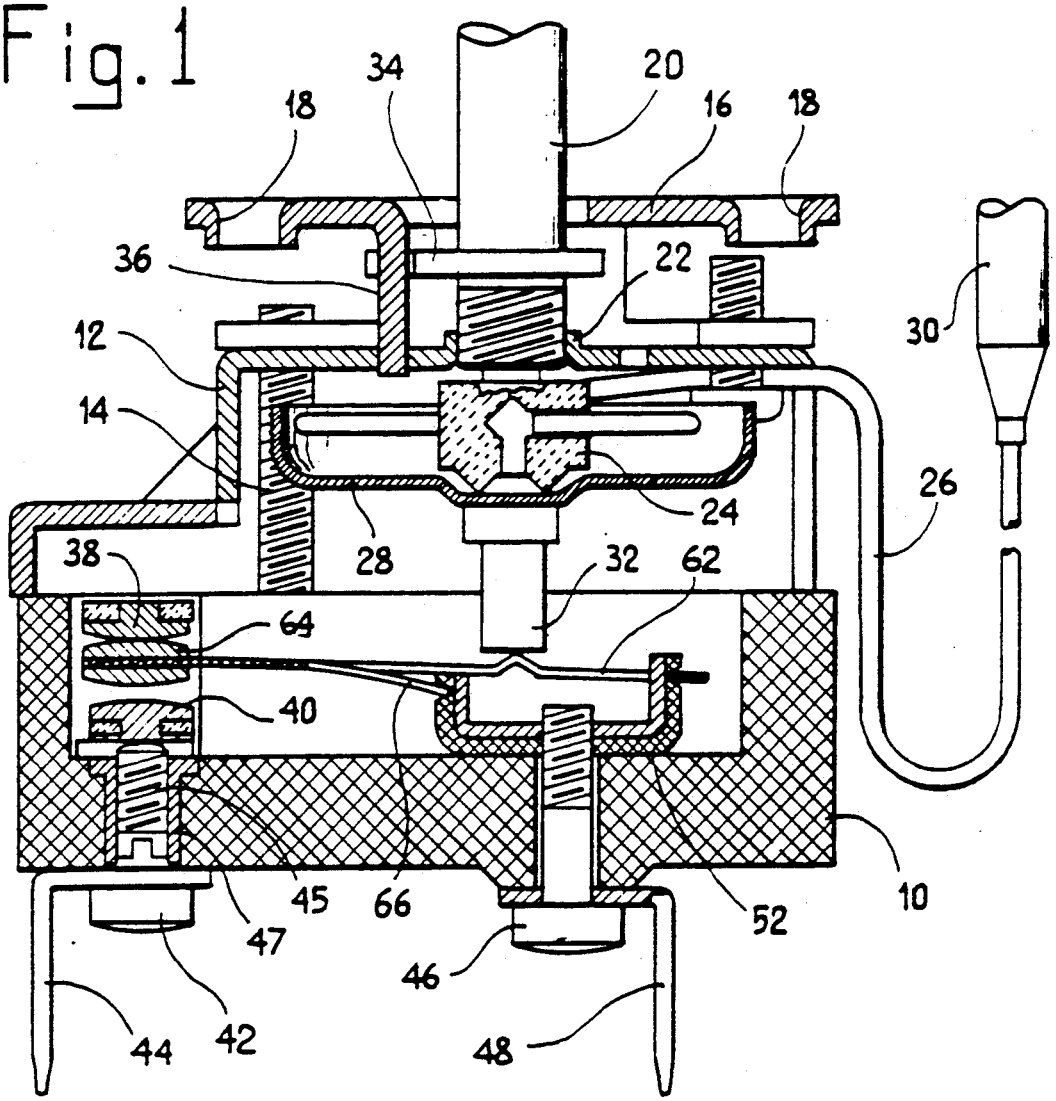
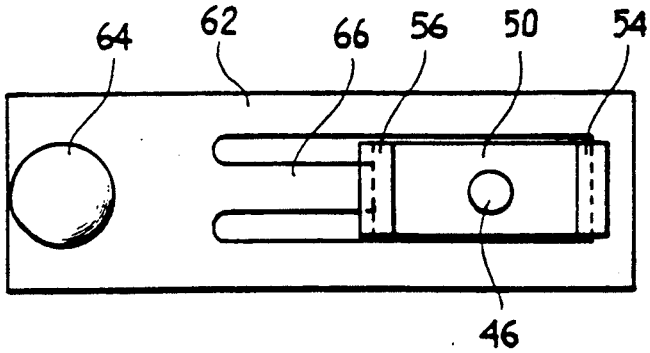
Fig. 2
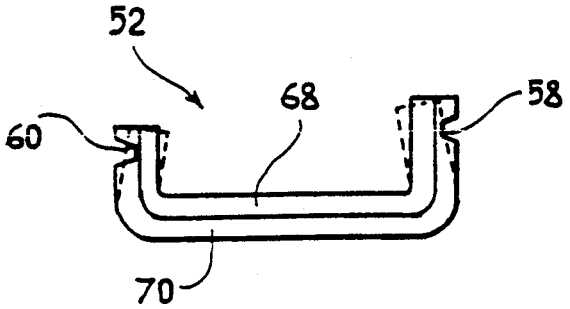
Fig. 3

ADJUSTABLE ELECTRIC THERMOSTAT WITH TEMPERATURE COMPENSATION

BACKGROUND OF THE INVENTION

This invention concerns an adjustable electric thermostat, particularly for home appliances, such as ovens and the like.

For the adjustment of the reference temperature, such thermostats include a shaft having an outside knob, threadedly engaged with respect to the housing of the thermostat, so that the shaft end changes its position as the knob is rotated, thus displacing the home position of a temperature transducer comprising an expansible bellows attached to the shaft end. The bellows is filled with a suitable fluid and is connected through a long capillary tube to a remote bulb acting as a temperature probe. Expansion of the fluid inside the bulb causes the bellows to expand and push down the blade of an electric switch to make or break a contact, thus turning on or off a heating circuit.

The thermostat is calibrated by maintaining its housing at normal temperature, say 20° C., and placing only the bulb in the heated environment. However, when the thermostat is used in an appliance such a cooking oven, the entire enclosure of the oven, in which the thermostat is mounted, becomes heated to a considerable extent. Therefore the entire housing of the thermostat, including the bellows, is affected by the temperature of the oven, and its inherent thermal expansion is added to the expansion of the fluid in the bulb, thus giving rise to an overcorrection. In the displacement-temperature diagram of the thermostat, this amounts to a parallel translation of the diagram. Prior atempts to solve this problem have consisted in incorporating in the thermostat a correcting mechanism which is sensitive to the temperature of the housing and acts in an opposite direction to the bellows. Since the displacement of the actuating mechanism in this kind of thermostat is in the order of 0.01 mm/°C., and the temperature drift can be as high as 30 to 40° C. when the measured temperature is 150° C., it turns out that the correcting mechanism must have an extremely small displacement, such as 0.002 mm/°C. Such a small displacement is difficult to achieve correctly, and temperature-compensated thermostats of the prior art have consequently been complex, bulky, and considerably more expensive than thermostats not provided with temperature compensation.

SUMMARY OF THE INVENTION

The primary object of this invention is therefore to provide an adjustable electric thermostat of the above kind, in which sensitivity to the ambient temperature is canceled or reduced by means which are simple and non-expensive, and which do not require any substantial change to the basis mechanical arrangement of the thermostat.

The invention achieves the above and other objects and advantages, such as will appear from the following specification, by means of an adjustable electric thermostat comprising a main housing in which an adjustment shaft is threadedly engaged so that the shaft end inside the housing is displaced when the shaft is turned, a heat transducer mounted on the shaft end, and a switch comprising a channel-shaped, rigid member having a base portion attached on a wall of the housing and opposite branches having notches to support a snap-action blade so that the temperature transducer abuts transversely against an intermediate point in the blade, wherein said channel-shaped member is made of a bimetal plate having the most expansible metal on the outside, so that the branches of the channel-shaped member bend toward each other when the channel-shaped member is heated.

BRIEF DESCRIPTION OF THE DRAWINGS

The invention will now be disclosed in more detail with reference to a preferred embodiment given by way of illustrative and non limiting example, and shown in the attached drawing, wherein:

FIG. 1 is a view, in axial cross-section, of an adjustable electric thermostat incorporating the improvements of the invention;

FIG. 2 is a plan view of the switch mechanism in the thermostat of FIG. 1; and FIG. 3 is a side view, on an enlarged scale, of a channel-shaped member which is part of the thermostat of FIG. 1.

DESCRIPTION OF PREFERRED EMBODIMENTS

With reference to FIGS. 1 and 2, an adjustable electric thermostat for an electric home appliance has a main housing comprising a base 10 of ceramic material and a cover 12 of punched metal sheet, joined together by means of screws such as 14. Screws 14 also retain a bracket 16, having threaded bores 18 for installation on the control panel of an appliance such as an oven (not shown).

A temperature adjustment shaft 20 is engaged in a bored and threaded boss 22 made in cover 12. One end of shaft 20 projects outside the housing and is splined to carry an adjustment knob (not shown) while the opposite end of shaft 20 projects inside the housing and carries a stud 24 from which a capillary tube 26 departs spirally, and cooperating with an expansible capsule 28, known per se. Capillary tube 26 leads to a temperature probing bulb 30. The other side of capsule 24 carries a ceramic pin 32.

A cam 34 is splined on shaft 20, so that it can interact with a stop 36 made in bracket 16 in order to limit the rotation of the shaft.

Two opposite, stationary contact beads 38, 40 are mounted in ceramic base 10 by means of screws such as 42, engaged in corresponding nuts (not shown), with attached electric plugs such as 44. The vertical position of bead 40 is adjustable by means of a set screw 45, engaged in a threaded bushing 47. A further screw 46, with a further electric plug 48, passes through the wall of ceramic base 10 and is threadedly secured to the base portion 50 of a channel-shaped member 52 (see alsp FIG. 3), with opposite branches 54, 56, projecting transversely from the base portion. Notches 58, 60 are cut in the branches, and a frame-shaped metal blade 62 is hooked in notch 58, and its distal end carries contact beads 64 aligned with beads 38, 40. A stub portion 66 projecting inwardly from the blade frame abuts elastically against notch 60, thus urging the distal end of blade 62 upwards.

When the bulb 30 is at a temperature not higher than the reference temperature, and the capsule is therefore fully retracted, the ceramic pin 32 abuts against an intermediate point of blade 62, but exerts little or no pressure on it. Therefore the blade is free to rise, and bead 64 abuts on stationary bead 38. However, when the capsule expands, the ceramic pin is moved downwards, and eventually exerts on blade 62 a force sufficient to overcome the force of stub 66, causing bead 64 to move to a lower position, where it abuts on bead 40, thus switching an electric circuit connected to the contact beads.

According to the invention, channel-shaped member 52 is made from a bimetal plate (see FIG. 3), with an inner layer 68 of a metal having a lower coefficient of expansion, and an outer layer 70 having a higher coefficient. Therefore, when the temperature of the entire housing rises, the branches of the channel-shaped member will bend inwardly, as shown in dotted lines on FIG. 3 (not to scale for clarity), giving rise both to a mutual approach between notches 58, 60 and to a lowering of the notches towards the base portion 50 of channel-shaped member 52. Such displacements are respectively proportional to the cosine and sine of the inclination angle of each branch from its rest position. While the approach between the branches of the channel-shaped member only causes a slight decrease of the elastic force on stub 66, having no practical consequences, the lowering of the notches, on the other hand, causes the entire blade 62 to come down a small amount, thus moving away from pin 32: when, as the temperature sensed by bulb 30 increases, pin 32 moves down against the blade, its interaction with the blade will take place place at a lower height than in the normal situation, i.e. the pin will have to travel farther to actuate the switch.

Since the channel-shaped member is subjected substantially to the same temperature affecting the capsule, with a suitable choice of the bimetal and a suitable sizing of channel-shaped member 52, the lowering of the blade due to the expansion of the bimetal will compensate with a good approximation the adverse effect of the temperature on the capsule, thus restoring the characteristic curve of the thermostat within the required tolerance. As the proportionality factor tying the ambient temperature and the blade lowering includes (as shown above) the sine of the inclination angle of the branches of the channel-shaped member, which is extremely small, it is easy by this approach to obtain the required small compensatory displacements, which are of the order of a few hundredths of a millimeter.

We claim:

1. An adjustable electric thermostat comprising a main housing in which an adjustment shaft is threadedly engaged so that a shaft end is located inside the housing and is displaced when the shaft is turned, a temperatue transducer mounted on the shaft end, and a switch comprising a snap-action blade and a channel-shaped, rigid member having a base portion attached on a wall of the housing, said member having opposite branches having notches supporting said snap-action blade said temperature transducer abuts transversely against an intermediate point in said blade, wherein said channel-shaped member is made of a bimetal plate having the most expansible metal said outside, so that said branches of the channel-shaped member bend toward each other when said channel-shaped member is heated.

* * * * *